United States Patent [19]

Szekely et al.

[11] Patent Number: 4,824,078

[45] Date of Patent: Apr. 25, 1989

[54] MAGNETIC STREAMLINING AND FLOW CONTROL IN TUNDISHES

[75] Inventors: Julian Szekely, Weston; Olusegun J. Ilegbusi, Cambridge, both of Mass.

[73] Assignee: Massachusetts Institute of Technology, Cambridge, Mass.

[21] Appl. No.: 87,151

[22] Filed: Aug. 19, 1987

[51] Int. Cl.[4] ..... C21B 13/00; C21C 5/42

[52] U.S. Cl. ..... 266/237; 266/44; 266/61; 266/275

[58] Field of Search ..... 266/44, 61, 237, 275

[56] References Cited

U.S. PATENT DOCUMENTS

| | | | |
|---|---|---|---|
| 2,732,292 | 1/1956 | Jordan | 75/10.14 |
| 3,246,373 | 4/1966 | Lyman | 164/499 |
| 3,735,799 | 5/1977 | Karlson | 164/147 |
| 4,495,984 | 1/1985 | Kollberg | 164/468 |
| 4,565,238 | 1/1986 | Kojima et al. | 164/468 |
| 4,632,368 | 12/1986 | Podrini | 266/275 |

OTHER PUBLICATIONS

ASEA Technical Specification, Electromagnetic Mold Brake Type ORM 325/80 S For Slab Continuous Casting Machines.

*Primary Examiner*—Peter D. Rosenberg

[57] ABSTRACT

A strong magnetic field, for example in the range of 500–50,000 Gauss, is applied across a tundish feeding continuous casting machines. The magnetic field, substantially perpendicular to the principal direction of flow within the tundish, provides very even flow in the tundish, uniform residence time and minimizes vortexing. The application of the magnetic field increases the percentage of inclusion particles removed from the melt during its residence within the tundish.

14 Claims, 3 Drawing Sheets

MAGNETIC STREAMLINING AND FLOW CONTROL IN TUNDISHES

BACKGROUND OF THE INVENTION

This invention relates to magnetic streamlining and flow control in tundishes.

Continuous casting is a major advance in the processing of metallic melts. In this operation the molten metal, which may be steel, aluminum, copper or the alloy of several metals, is poured from a ladle (or more infrequently directly from a furnace) through an intermediate vessel, called a tundish, into molds, where solidification takes place, yielding continuous slabs, billets or bars.

In most conventional steel (including stainless steel) applications this tundish is a trough, some several meters long, about a meter deep and a meter wide. Molten metal is poured into the tundish at one point and molten metal streams are discharged through two or more outlet nozzles. Initially the main role assigned to these tundishes was to distribute the liquid and to act as a buffer ensuring uniform metal flow. More recently it has been appreciated that the operation of tundishes play a key role in affecting the quality of continuously cast steel products.

This is due to several factors. One of these is that for properly designed tundishes flow disturbances, such as vortexing and flow fluctuations are minimized, which then result in the products having a better surface quality. Another is that for properly designed tundishes non-metallic impurities, termed inclusions, will have an opportunity to float out, resulting in a product of superior quality. Yet in other applications proper tundish design can minimize the temperature fluctuations in the system and allow for a uniform temperature of all the exiting streams. Furthermore, better control of the temperature in tundishes may be achieved through auxiliary heating.

The recognition of these factors had led to extensive physical (water) and mathematical modeling of tundish systems, in order to improve the quality of continuously cast products. Several known, well documented tundish designs include the use of dams, weirs and other internal elements, having the objective of providing flow control. Yet these efforts have not been fully successfuly, because significant dead zones may exist in the lee of the dams and the weirs, reducing the effective tundish volume.

In addition to tundishes used in the conventional continuous casting of steel, which are troughs of the type described above, other types of tundishes also exist, notably in the processing of non-ferrous metals and in association with novel continuous casting proceses.

In many of these operations the tundish is a shallow pan, having a depth of say 50–250 millimeters, with the other dimensions ranging from a few hundred to a few thousand millimeters. Typically these systems have one inlet and one or two outlets. The main function of these tundishes is to provide for an even distribution of the flow from the ladle to the mold. In many of these applications, particularly those involving the new continuous casting systems, such as single or double roll continuous casting operations, belt casters and the like, the ability to provide a smooth, spatially uniform flow is a critical requirement.

SUMMARY OF THE INVENTION

According to the invention, we attach an apparatus to the tundish, which generates a stationary magnetic field, perpendicular to the principal direction of the flow. This magnetic field may be imposed throughout the vessel, but may also be localized, in the vicinity of the inlet and the outlet regions, or may just be confined to the vicinity of the inlet region. A suitable magnetic field may range from 500-50,000 Gauss but is not necessarily confined between these limits. Mathematical simulations indicate that the imposition of such fields for conventional tundish operations will provide for a much more uniform flow, will minimize short circuiting or by-passing, will minimize vortexing and will promote the floatation of inclusion particles.

When applied to shallow tundishes, e.g. in many non-ferrous processing applications and in conjunction with novel continuous casting systems, the imposition of the magnetic field will provide the essential flow uniformities and will minimize flow disturbances.

DESCRIPTION OF THE PREFERRED EMBODIMENT

Figure 1:
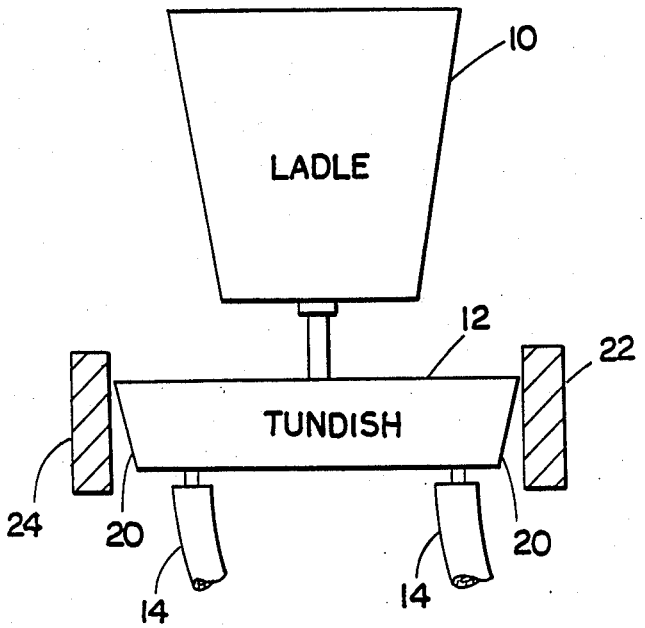
FIG. 1 is a cross-sectional, schematic illustration of a continuous casting system.
Figure 2:
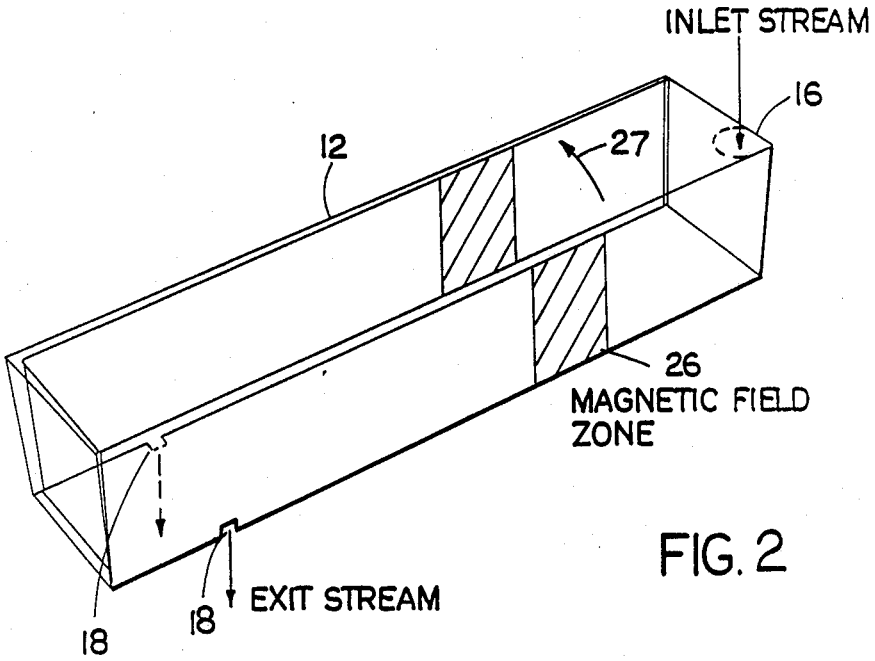
FIG. 2 is a perspective view of the tundish shown in FIG. 1.

With reference first to FIG. 1, molten metal such as steel is poured from a ladle 10 through a tundish 12 into molds 14 where solidification takes place. As shown in FIGS. 1 and 2, the tundish 12 is a relatively shallow trough (typically about 4–8 meters long, a meter wide and a meter deep), into which molten steel is poured at an inlet portion 16 and withdrawn at outlet portions 18. The tundish 12 may have angled walls 20. Tundishes such as the tundish 12 may also include internal flow control devices such as weirs and dams (not shown).

According to the invention, magnetic poles 22 and 24 flank the tundish 12 to generate a steady magnetic field zone 26 across the tundish. The magnetic field, preferably generated by electromagnets, has a strength in the range of 500–50,000 Gauss. The magnetic field in the magnetic field zone 26 is approximately perpendicular to the principal direction of the molten metal flow from the inlet portion 16 to the exit portion 18. The magnetic field direction is shown by an arrow 27. As will be appreciated by those skilled in the art, as the metal flows through the magnetic field zone 26, currents will be induced in the metal. These currents generate their own magnetic field which interacts with the externally applied field to result in a braking force opposing the motion of the molten metal. The application of the magnetic field thus tends to slow down and streamline the flow through the tundish 12.

Similar arguments would apply to shallow tundishes, such as used in novel continuous casting processes for steel ferrous alloys and superalloys and in the processing of non-ferrous metals, such as copper, aluminum or their alloys. Here again a steady magnetic field would be applied in a direction perpendicular to the principal flow direction, by placing magnets or electromagnets close to the vertical walls.

Fluid flow phenomena in the tundish 12 have been mathematically modeled by the applications herein at the Massachusetts Institute of Technology. The controlling turbulent Navier-Stokes equations were solved utilizing the Phoenics computational code. See, D. B. Spalding, "Mathematics and Computers in Simulation", XIII, 267–276 (1981).

Figure 3:
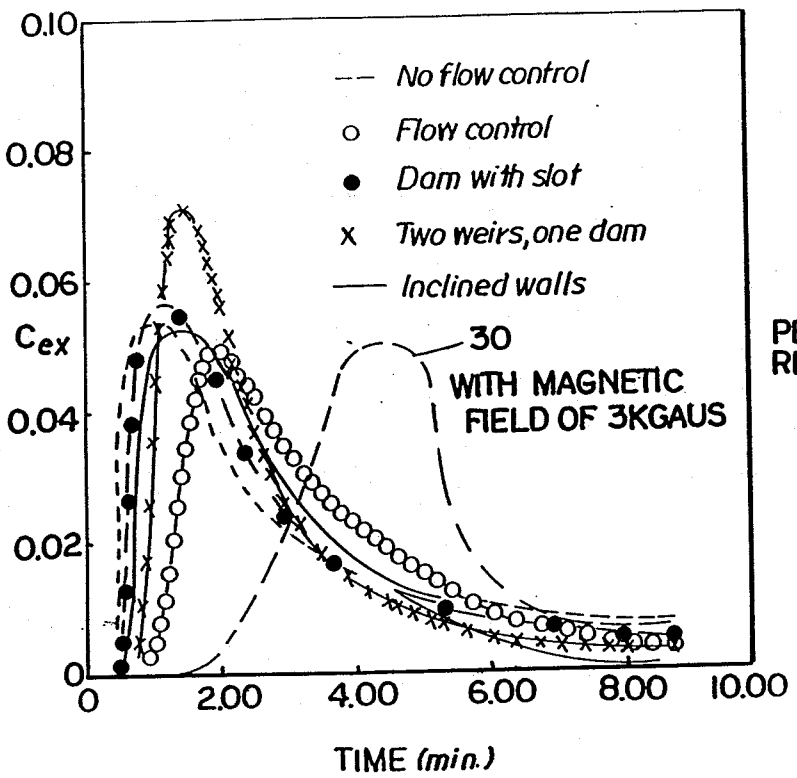
FIG. 3 includes graphs of tracer concentration at the tundish exit as a function of time for flow control devices in the tundish and magnetic field control.

FIG. 3 illustrates one result of the simulation showing tracer concentration $C_{ex}$ at the tundish outlet as a function of time for various tundish configurations. A curve 30 shows the results of the simulation with the application of a 3,000 gauss magnetic field. Note that the peak in tracer concentration of the curve 30 is significantly shifted in time with respect to the other curves representing tundishes with internal flow control devices illustrating the efficiency of the magnetic streamlining.

Figure 4:
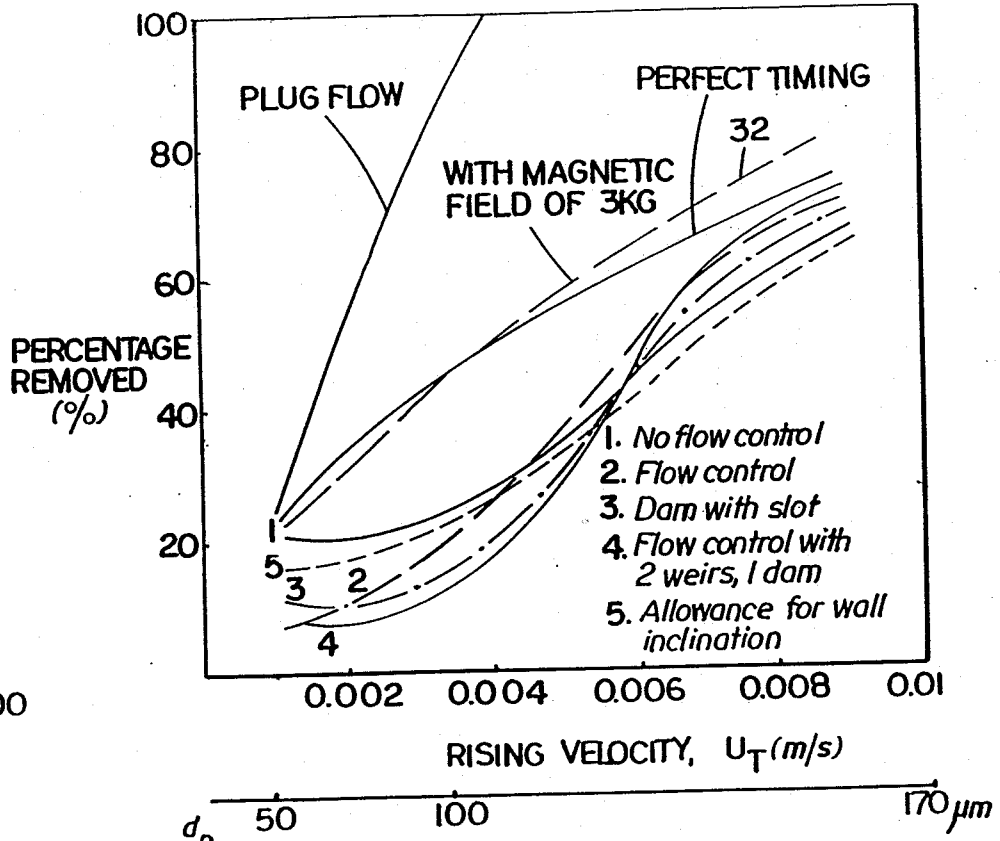
FIG. 4 includes graphs of the percentage of inclusion particles removed as a function of particle rising velocity.

FIG. 4 shows yet another result of the simulation. In FIG. 4, the percentage of inclusion particles removed is plotted against inclusion particle rising velocity $U_T$. The lowermost scale in FIG. 4 is inclusion particle diameter which is proportional to rising velocity. A curve 32 in FIG. 4 is the result of the simulation with a magnetic field of 3,000 gauss. Note that the curve 32 indicates a very significant improvement in the percentage of inclusion particles removed as compared with other tundish flow control techniques. The present invention improves the quality of the resulting metal product in that higher percentages of inclusion particles are removed while the molten metal is in the tundish.

Figure 5:
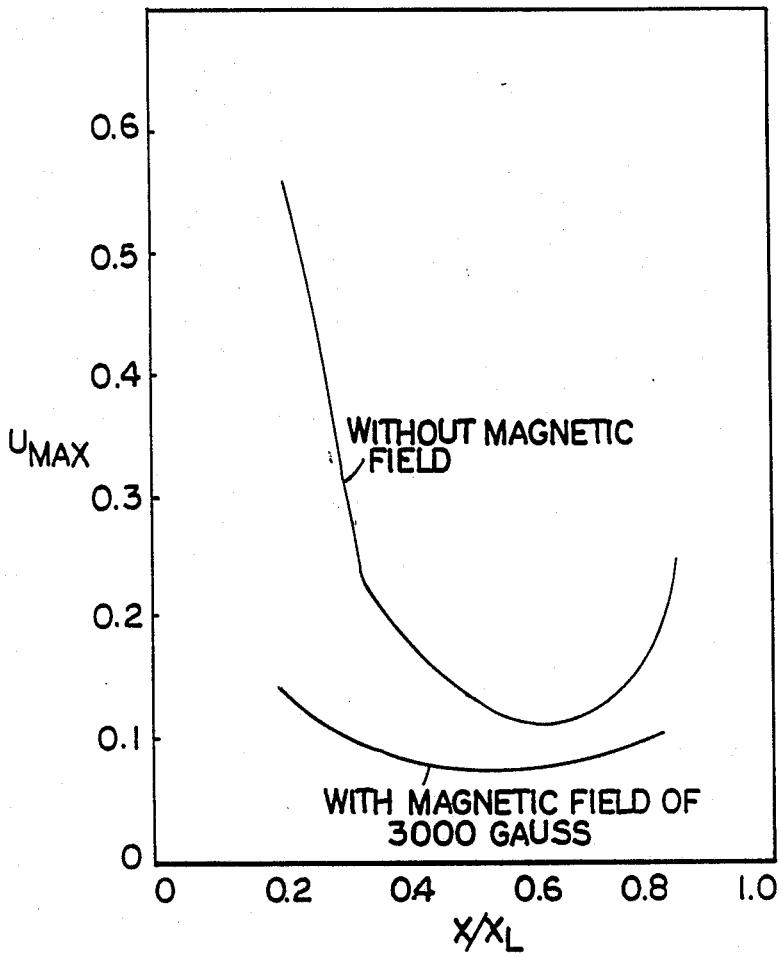
FIG. 5 shows a schematic sketch of the computed maximum centerline velocity for a shallow (20 cm deep) tundish, in the presence and in the absence of a transverse magnetic field.

FIG. 5 shows the computed maximum centerline velocities for a shallow tundish, 20 cm deep, 50 cm wide and 1 meter long. It is seen that in the absence of a magnetic field there is a very large variation in the centerline velocity as we proceed from the inlet to the exit, with a correspondingly large lateral spread in the local velocities throughout the vessel.

In contrast, through the imposition of a magnetic field of 3,000 Gauss, the centerline velocity will be made rather uniform.

Although this disclosure has used steel as the exemplary metal, it will be appreciated by those skilled in the art that the present techniques are applicable to the casting of other metals. It is further recognized that modifications and variations of the invention disclosed herein will occur to those skilled in the art and it is intended that all such modifications and variations be included within the scope of the appended claims.

What is claimed is:

1. A tundish for receiving molten metal at an inlet portion and for discharging the metal at one or more outlet portions comprising magnetic field generating apparatus adapted to generate a magnetic field across the tundish that extends the full depth of the molten metal in the tundish at a location between the inlet and outlet portions, the magnetic field being substantially perpendicular to the principal direction of the flow of the molten metal in the tundish.

2. The tundish of claim 1 wherein the magnetic field strength is in the range of 500–50,000 Gauss.

3. The tundish of claim 1 wherein the metal is steel.

4. The tundish of claim 3 having a length in the range of 2–7 meters, a depth in the range of 0.5–1 meter, and a width in the range of 2.5–2 meters.

5. The tundish of claim 1 wherein the metal is nonferrous.

6. The tundish of claim 5 wherein the tundish has a length of approximately 1 meter, a depth in the range of 4–20 centimeters, and a width in the range 0.5–1 meter.

7. The tundish of claim 1 for use in continuous casting processes having a length in the range of approximately 0.5–1 meter, a depth in the range of approximately 4–60 centimeters, and a width in the range of approximately 0.5–1 meter.

8. The tundish of claim 1 wherein the metal is copper.

9. The tundish of claim 1 wherein the metal is aluminum.

10. The tundish of claim 1 wherein the metal is stainless steel.

11. The tundish of claim 1 wherein the metal is a metallic alloy.

12. The tundish of claim 1 wherein the magnetic field encompasses the whole tundish.

13. The tundish of claim 1 wherein the magnetic field location is near the inlet portion.

14. The tundish of claim 1 wherein the magnetic field location is near the one or more outlet portions.

* * * * *

UNITED STATES PATENT AND TRADEMARK OFFICE

CERTIFICATE OF CORRECTION

PATENT NO. : 4,824,078

DATED : April 25, 1989

INVENTOR(S) : Julian Szekely and Olusegun J. Ilegbusi

It is certified that error appears in the above-identified patent and that said Letters Patent is hereby corrected as shown below:

Column 1, line 47, change "successfuly," to --successful,--;
line 56, change "ceses" to --cesses--.

Column 3, line 10, change "applications" to --applicants--.

Column 4, line 24, change "2.5" to --0.5--.

Signed and Sealed this

Second Day of January, 1990

*Attest:*

JEFFREY M. SAMUELS

*Attesting Officer*

*Acting Commissioner of Patents and Trademarks*